United States Patent [19]

Chang

[11] 4,311,351

[45] Jan. 19, 1982

[54] REFRIGERATOR CABINET CONSTRUCTION

[75] Inventor: Tsung K. Chang, Louisville, Ky.

[73] Assignee: General Electric Company, Louisville, Ky.

[21] Appl. No.: 132,015

[22] Filed: Mar. 20, 1980

[51] Int. Cl.[3] ..... F25D 11/00; B29D 9/00

[52] U.S. Cl. ..... 312/236; 312/214; 264/45.5

[58] Field of Search ..... 312/214, 236, 296; 264/45.4, 302; 52/309; 220/9

[56] References Cited

U.S. PATENT DOCUMENTS

| | | | |
|---|---|---|---|
| 3,137,744 | 6/1964 | Burrus | 264/45 |
| 3,310,616 | 3/1967 | Beary | 264/45 |
| 3,369,336 | 2/1968 | Buzicky | 52/302 |
| 3,440,308 | 4/1964 | Carbary et al. | 264/45 |
| 3,478,135 | 11/1969 | Randall | 264/45 |
| 3,489,477 | 1/1970 | Harder | 312/236 |
| 3,512,323 | 5/1976 | Huffer | 264/45 |
| 3,789,094 | 1/1974 | Hutchison | 264/45 |
| 3,933,398 | 1/1976 | Haag | 312/236 |
| 3,989,328 | 11/1976 | Nonomaque et al. | 312/214 |
| 4,082,825 | 4/1978 | Puterbaugh | 264/46.5 |
| 4,118,451 | 10/1978 | Schaus | 264/45.5 |
| 4,162,571 | 7/1979 | Horway | 29/460 |

*Primary Examiner*—Victor N. Sakran
*Attorney, Agent, or Firm*—Frederick P. Weidner; Radford M. Reams

[57] ABSTRACT

A refrigerator cabinet having an outer shell with an opening at the front thereof, an inner liner within and spaced from the shell and bonded thereto by a body of foamed plastic insulating material. A rigid foam member is located in the space between the shell and liner between the insulating material and the outer shell opening. The rigid foam member has a passage for venting air from the insulation space during foaming of the insulation material and that passage is undulated sufficiently to prevent the foam insulation material from passing therethrough.

10 Claims, 4 Drawing Figures

REFRIGERATOR CABINET CONSTRUCTION

BACKGROUND OF THE INVENTION

This invention relates to cabinet construction and, in particular, to a refrigerator appliance cabinet construction.

Insulated wall structures are known wherein the cabinet wall structure includes an inner panel or liner, an outer shell, and a body of foamed-in-place insulation therebetween. A sheet of fibrous material has been employed to extend across the space defined by the front edges of the liner and shell to define a boundary of the foamed-in-place insulation. The fibrous material also allows air to be vented during the foaming process.

In some instances, the technique of foaming-in-place utilizes a sealing material, such as a flexible polyurethane foam pad, which is captured between the liner and shell but is movable enough to allow air to be vented during the foaming process. This type of technique is shown in U.S. Pat. No. 3,489,477, assigned to the same assignee as that of the present invention.

In U.S. Pat. No. 3,989,328, a strip of rigid foam is provided for closing the front opening between the inner liner and outer shell of the appliance cabinet. The rigidity of the foam strip permits the strip to serve as a means for holding the liner centered within the cabinet shell during the assembly thereof. The foam strip also has vent passages which permit air and gases evolved in the foaming operation to escape from the insulation space between the liner and cabinet shell. The passages self-seal, as by being plugged with the foam.

A problem encountered in making refrigerators involves preventing the foam from contacting and plugging up openings in the front of the outer shell that should remain open. Such openings, for example, are for switches utilized in turning on an interior light of the refrigerator when the doors are open and off when closed. It is desirable to be able to prevent the foam, during assembly of the liner and outer shell, from plugging up these openings so that the switches and electrical wires may be subsequently assembled without being hindered by any solidified foam in that area. To prevent the foam from reaching these openings, foam stop means may be employed which, desirably, have venting means so that air and gases evolved during the foaming operation may be expelled from between the liner and outer shell, thus allowing the foam to completely fill the insulation space therebetween. U.S. Pat. No. 3,989,328 does show such a venting means; however, it has been found in practice that the volume of air and evolved gases that must be expelled from the insulation space is considerable and the vent means must be relatively large to accommodate the process. However, it has also been found that when the vent passages are large enough to adequately handle the volume of air and gases being expelled, they are prone to also allow the foam to pass therethrough into the area that is to be kept free of the foam. This is particularly the case in connection with side-by-side refrigerator/freezers, that is, those refrigerating appliances that have side-by-side doors with the freezer on one side of the cabinet and the fresh food on the other. In this kind of refrigerator cabinet in particular, a large volume of air and gases must be expelled from the insulating space between the liner and outer shell during the foaming-in process and it is expelled out the bottom of the cabinet where the openings for switches, etc. are located.

By this invention, there is provided a foam stop means to prevent the foam from reaching openings at the front of the refrigerator cabinet, yet have sufficient venting means to allow the passage of gases and air being expelled from the insulation space between the liner and outer shell during the foaming-in process. In addition, this foam stop means is made of rigid insulating material that adds strength to the assembly, is easy to install during cabinet assembly and has good thermal insulation characteristics.

SUMMARY OF THE INVENTION

According to one aspect of my invention, there is provided a refrigerator cabinet having an outer shell with an opening at the front thereof and an inner shell within and spaced from the outer shell and bonded thereto by a body of foamed plastic insulating material formed in the space between the shell and liner after assembly of the liner within the shell. There is a rigid foam member located in the space between the shell and liner between the insulating material and shell opening, the rigid foam member having a passage for adequately venting air and gases from the insulation space during foaming of the insulation material. The passage is undulated sufficiently to prevent the foam insulation from passing therethrough. By this arrangement, air and gases may be expelled from the insulating space, yet the foam will not pass through the passage to block the opening at the front of the outer shell.

DESCRIPTION OF THE PREFERRED EMBODIMENT

Figure 1:
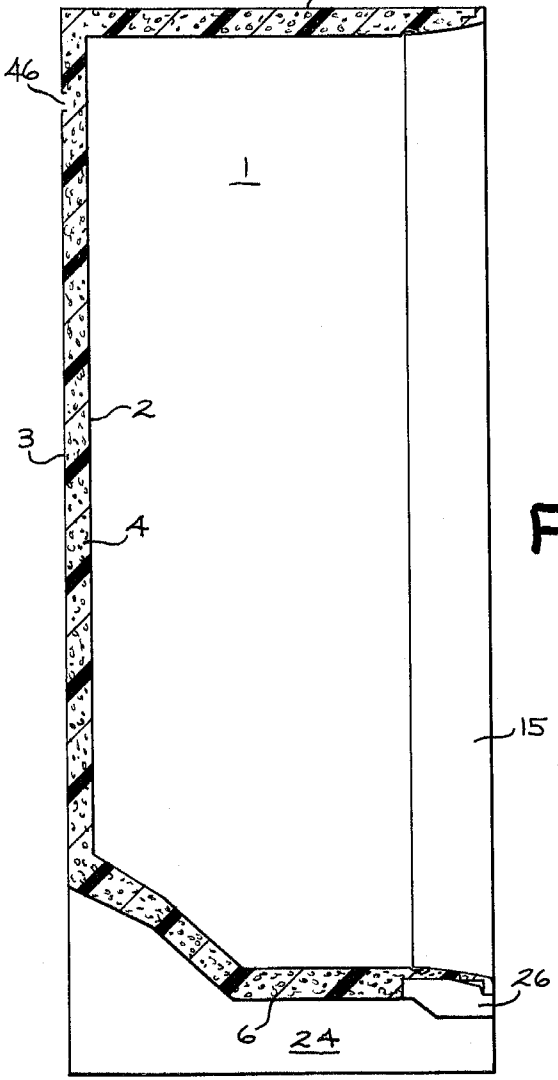
FIG. 1 is a side elevational view, partly in section, of a refrigerator cabinet showing one embodiment of the present invention.

With reference to the Drawings, FIG. 1 illustrates, in section, a generally rectangular refrigerator cabinet comprising a storage compartment 1 defined by a liner 2 and having an access opening at the front thereof closed by a door (not shown). The liner 2 is contained within and spaced from an outer shell 3 forming the exterior surfaces of the cabinet and the space between the inner and outer shell is filled with a foamed resin insulating material 4 which is foamed in place between the liner and shell and serves to bond these two components together.

Figure 3:
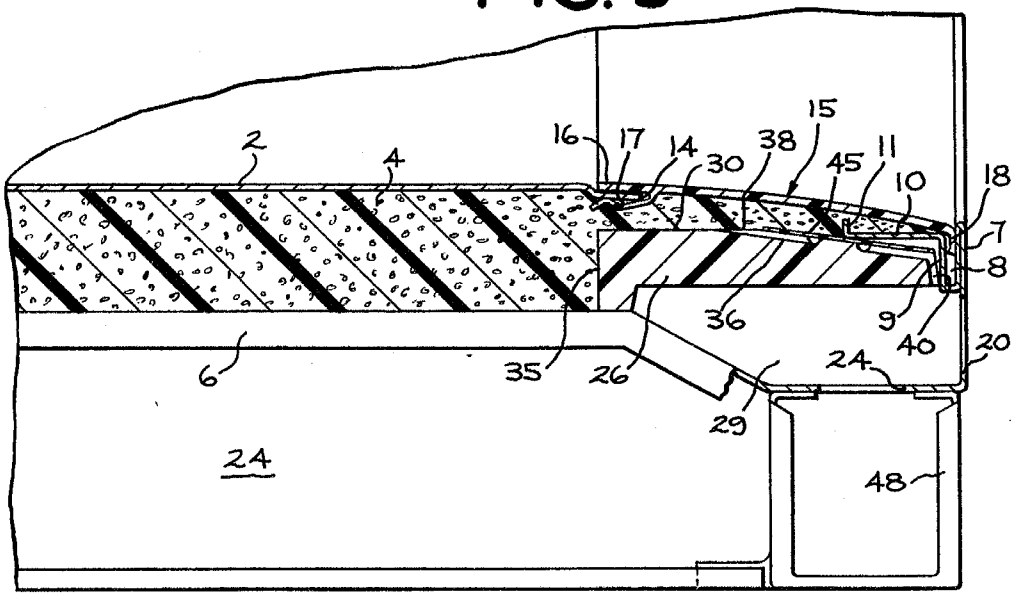
FIG. 3 is a fragmentary cross sectional view of a portion of the refrigerator of FIG. 1 showing one embodiment of the present invention.
Figure 4:
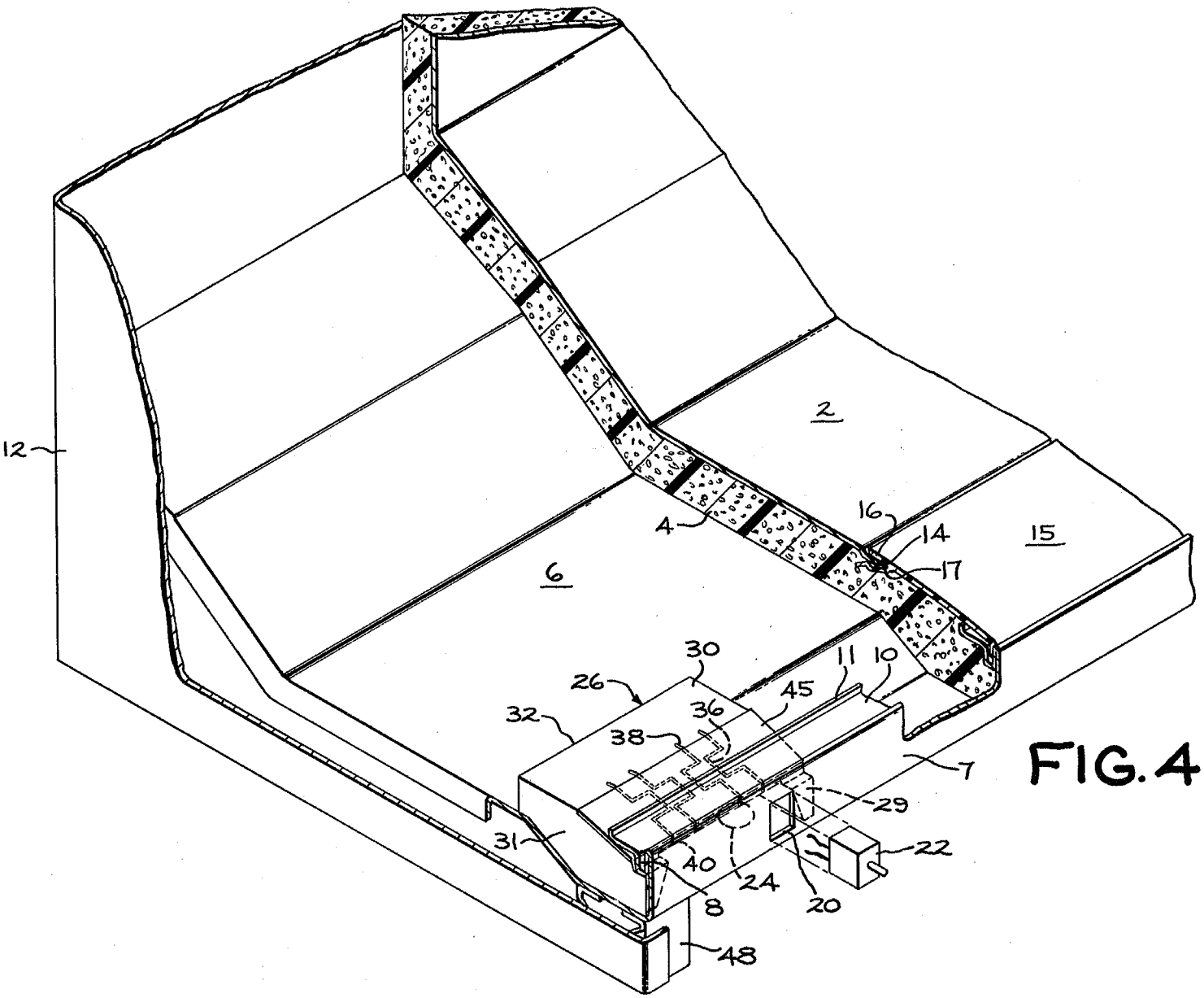
FIG. 4 is a fragmentary perspective view of the refrigerator of FIG. 1 showing one embodiment of the present invention.

The outer shell 3 includes opposite side walls 12, as well as a top wall 5 and bottom wall 6, and the forward edge portions of each of these walls surrounding the access opening to the storage compartment 1 is formed to include flange 7. As viewed in FIGS. 3 and 4 particularly, flange 7 extends at right angles to the bottom wall 6. This flange is bent back upon itself, as shown in FIGS. 3 and 4 of the drawings, to define an inwardly open channel section 8, including a front wall composed of the double thickness flange 7 and a rear wall 9. The material of the bottom wall 6 of the outer shell 3 is further bent to include a rearwardly extending web 10 with an upwardly depending terminal end 11.

The rectangular liner 2 which is of dimensions such that it can be inserted into the formed shell through the rectangular opening defined by the face flanges 7 includes forward edges 14 which are spaced rearwardly from the flange terminal end 11 when the liner is assembled within the shell 3. Breaker strips 15 include relatively flat main portions 16 bridging the spaces between the flanges 7 forming the front wall of the channel 8 and the forward edges 14 of the liner 2.

Each breaker strip 15, which is preferably formed of a plastic material, includes a narrow channel section 17 along the rear edge thereof for receiving and engaging the forward edge 14 of the liner. Each breaker strip 15 includes a downwardly extending lip portion 18 along the forward edge thereof adapted to be received in channel 8 where it can be fastened by means of clips (not shown) retained in channel 8. Such a structural arrangement is shown and described in U.S. Pat. No. 3,489,477 referred to previously.

There is provided at the front of the refrigerator cabinet openings 20 and 24 in the outer shell 3 to provide means for positioning therein a switch 22, which switch, in the case of the preferred embodiment, is utilized in a side-by-side refrigerator to turn on the interior light when the door of compartment 1 is opened and off when closed. Electrical wires leading to the switch pass downwardly through opening 24 in the bottom wall 6 of the outer shell 3 and into the underlying and rearward machinery compartment 24 for connection to an appropriate electrical source. The switch 22 and electrical wires are assembled into the refrigerator cabinet subsequent to assembly of the liner to the outer shell and the insulation foaming operation. It is, therefore, highly desirable that the foam be prevented from reaching the openings 20 and 24 so that this switch assembly may be easily made.

Figure 2:
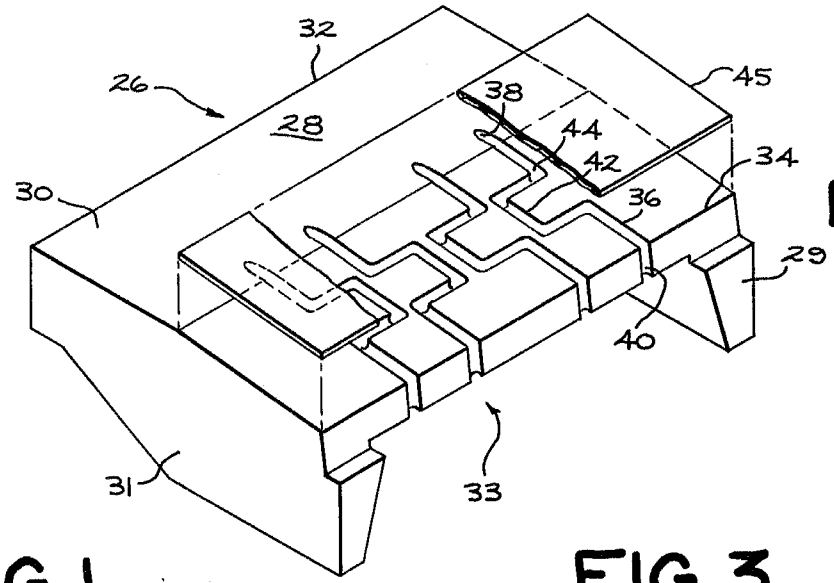
FIG. 2 is a perspective view of the rigid foam member utilized in the present invention.

To prevent the foam from blocking the openings 20 and 24, yet allow the evolving gases and air to be expelled from the insulation space occupied by the insulating material 4 during the foaming-in operation, there is provided a rigid foam member 26, particularly shown in FIG. 2. The rigid foam member is made from suitable material, such as styrofoam, and is dimensioned to fit within the space between the outer shell 3 and the inner liner 2 and is located between the insulating material and the outer shell openings 20 and 24. The body 28 of the rigid foam member 26 has a top wall or surface 30 which extends from the rear edge 32 to the front edge 34. The top surface 30 has at least one passage 36 and preferably a plurality of passages 36 which are in the form of grooves formed in the body 28 on the top surface 30. The passages 36 have a inlet portion 38, an outlet portion 40, and an intermediate portion 42. The passage 36 is undulated and, in the preferred embodiment, the undulation consists of right angle turns with each passage having at least two such right angle turns. Preferably, as shown in FIG. 2, there are four right angle turns 44 for each passage 36. In the case of the rigid foam member 26 shown in FIG. 2, the outlet portion 40 of the passage 36 is downwardly directed. To prevent foam from entering the intermediate portion 42 of the passage 36, there is applied across the top of the passage a sheet of material 45, such as tape adhered to the top surface 30 of the body 28. The tape 45 covers the intermediate portion 42 of each of the passages 36. It will be understood that the inlet portion 38 and the outlet portion 40 of the passages 36 will not be covered by the sheet of material so that air and gases may enter the passages 36 at the inlet portion 38 and exit the passages 36 at the outlet portion 40 during the insulation foaming operation. The rigid foam member 26 has two spaced legs 29 and 31 with an open space 33 therebetween at the front; however, there is no space at the rear between the bottom wall 6 and the rigid foam member 26. The bottom surfaces of the legs 29 and 31 and rear wall 35 are contoured to fit the contour of the bottom wall 6 along both legs 29 and 31 and the rear wall 35 so that there are no gaps through which foam insulation can pass.

In the assembly of the refrigerator, the outer shell 3 has a bottom wall 6, including the upturned flange 7 and inwardly depending web 10, and may be secured to support legs 48 of the cabinet. The rigid foam member 26 is placed at the forward portion of the outer shell 3 with the bottom of the spaced legs 29 and 31 and rear wall 35 in contact with the bottom wall 6. The forward portion of the rigid foam member 26 is inserted into the space formed by the flange 7 and web 10 such that the rigid foam member 26 is retained in the position shown in FIGS. 3 and 4. The legs 29 and 31 span the openings 20 and 24 in the bottom wall 6. The preferred routine assembly further comprises attaching suitable lengths of breaker strip material or a pre-assembled "frame" of breaker strips 15 to the forward edges 14 of the liner 2, as previously described. Thereafter, with the outer shell 3 lying on its back, the liner and breaker strip assembly are dropped into the outer shell 3 to the position generally illustrated in FIG. 3 of the drawings in which the lips 18 of the breaker strips 15 are received in the channel 8 between the flange 7 and the rear wall 9 and suitably secured thereto.

Thereafter, the cabinet is turned on its face in a suitable mold designed to maintain the shell and liner in their proper spaced relationship and support the walls thereof. A liquid foamable resin, which is preferably a foamable polyurethane resin, is introduced into the space between the liner 2 and the shell 3 through one or more openings 46 in the back wall of the shell. The froth foam, or partially foamed liquid polyurethane resin, flows downwardly towards the lower forward edges of the cabinet walls. During the foaming-in operation air and gases, under the pressure of the expanding foam, escape from the insulation space through the passages 36 formed in the rigid foam member 26. When the foam reaches the rigid foam member 26, it covers the top surface 30 as shown particularly in FIG. 3 and fills the space between the rigid foam member 26 and the overlying breaker strip 15. The foaming resin, upon reaching the passages 36 at the inlet portion 38, will enter the passages 36 and flow through a portion thereof until the pressure is diminished by the undulations of the passage, such as the right angles 44 formed therein, and will solidify before passing through the passages 36. Any form of undulations of the passage 36 that reduces the pressure of the foaming insulation sufficiently would be acceptable. Thus, the foam insulation is prevented from reaching the openings 20 and 24 in the bottom wall 6 of the outer shell 3 because the foam insulation is effectively blocked by means of the rigid foam member 26. The foam insulation, when solidified, acts to add rigidity to the cabinet construction and actually bonds together the components of the outer shell 3, the rigid foam member 26, the breaker strips 15 and the liner 2.

Thereafter, during assembly of the refrigerator, the switch 22 is securely placed in the opening 20 in flange 7 and the electrical wires leading from the switch 22 are directed through the opening 24 in the bottom wall 6 of the outer shell 3 into the machinery compartment 24 for proper connection to an appropriate electrical energy source.

The foregoing is a description of the preferred embodiment of the invention and it should be understood that variations may be made thereto without departing from the true spirit of the invention as defined in the appended claims.

What is claimed is:

1. A refrigerator cabinet comprising:

an outer shell having an opening at the front thereof;

an inner liner within and spaced from said shell and bonded thereto by a body of foamed plastic insulating material formed in the space between said shell and liner after assembly of said liner within said shell;

a breaker strip interconnecting the outer shell and inner liner; and a rigid foam member located in the space between the shell and liner underlying the breaker strip and between the insulating material and shell opening, said rigid foam member having a passage for venting air from the insulation space during foaming of the insulation material, said passage being undulated sufficiently to prevent the foam insulation material from passing therethrough.

2. The refrigerator of claim 1 wherein the passage is a groove with an inlet portion and outlet portion and an intermediate portion formed in the rigid foam member and a sheet of material covers the intermediate portion of the passage.

3. The refrigerator of claim 2 wherein the sheet of material is a tape adhered to the rigid foam member across the top of the groove.

4. The refrigerator of claim 1 wherein the passage is undulated by at least two right angle turns.

5. The refrigerator of claim 1 wherein there is a plurality of passages in the rigid foam member.

6. The refrigerator of claim 1 wherein the rigid foam member is formed of styrofoam.

7. The refrigerator of claim 1 wherein the outer shell includes a bottom wall having a return bend flange portion with the opening being in said return bend flange portion.

8. The refrigerator cabinet of claim 1 wherein the cabinet is for a side-by-side refrigerator.

9. The refrigerator cabinet of claim 1 wherein the outer shell and inner liner are interconnected with a breaker strip made of plastic material and the opening in the outer shell is for receiving switch means and the rigid foam member is located in the insulating space between the outer shell and inner liner underlying the breaker strip and separating the insulating space from the opening.

10. The refrigerator cabinet of claim 9 wherein the outer shell includes a bottom wall having an upwardly directed flange with the opening and terminates with an inwardly directed web and the breaker strip innerconnects the inwardly directed web and the inner liner.

* * * * *